US005325645A

United States Patent [19]

Wrightman

[11] Patent Number: 5,325,645

[45] Date of Patent: Jul. 5, 1994

[54] INTERSECTING JOINT

[75] Inventor: Ronald A. Wrightman, Bracebridge, Canada

[73] Assignee: True North Log Homes, Bracebridge, Canada

[21] Appl. No.: 759,039

[22] Filed: Sep. 5, 1991

Related U.S. Application Data

[63] Continuation of Ser. No. 514,824, Apr. 26, 1990.

[30] Foreign Application Priority Data

Nov. 23, 1989 [CA] Canada ..... 2002665

[51] Int. Cl.[5] ..... E04B 1/10

[52] U.S. Cl. ..... 52/233; 52/284; 52/286

[58] Field of Search ..... 52/233, 286, 284

[56] References Cited

U.S. PATENT DOCUMENTS

| | | | |
|---|---|---|---|
| 3,166,802 | 1/1965 | Schmidgall | 52/286 |
| 3,189,950 | 6/1965 | Johnson | 52/233 |
| 3,552,079 | 1/1971 | Mortensen | 52/233 |

FOREIGN PATENT DOCUMENTS

| | | | |
|---|---|---|---|
| 968921 | 6/1975 | Canada | 52/233 |
| 350452 | 1/1961 | Switzerland | 52/233 |

*Primary Examiner*—Michael Safavi
*Attorney, Agent, or Firm*—Baker & Daniels

[57] ABSTRACT

A 'log' home is formed by horizontal structural members that are notched at the intersection to form a corner. Springs are inserted in the notch to bias two surfaces of the adjacent logs into engagement so that expansion and contraction are accomodated on the opposite sides of the notch.

9 Claims, 4 Drawing Sheets

INTERSECTING JOINT

This is a continuation of application Ser. No. 07/514,824, filed Apr. 26, 1990 now abandoned.

The present invention relates to the construction of corners for buildings.

There are many different methods for making walls of a building and one of the most fundamental is the stacking of logs one above the other. This type of construction is used to produce so-called 'log' houses although it is now common to utilize machined lumber of uniform size as well as true logs.

In any construction, it is necessary to tie the intersecting walls of the building to one another for structural integrity and this is conventionally done in log construction by notching the logs where they intersect so that each wall may extend past the other. The notches may be part cylindrical where unmachined logs are used, dovetailed or in the form of a cross halving joint where machined logs are used.

The logs utilized are usually 'green', i.e. unseasoned, and therefore after construction it is inevitable that some shrinkage will occur in the joints between intersecting members. Moreover, temperature and humidity variations between seasons also causes movement between the members. This is a particular problem where it is necessary to seal the interior of the building from the exterior, such as when the building is to be used as a house, and it is usual to caulk the joints to effect the seal. However, this is time-consuming and needs refurbishing on a regular basis. Attempts have been made to provide a tight fit in the joint but this can lead to cracking of the ends of the logs during assembly.

It is therefore an object of the present invention to obviate or mitigate the above disadvantages.

According to the present invention, there is provided a corner construction for the intersecting walls of a building having walls formed from a plurality of horizontal structural members stacked one above another, each of said members having notches in their upper and lower surfaces at the corner to allow the members of each wall to extend past the other, each of said notches having a pair of spaced vertical surfaces juxtaposed with oppositely directed flanks of the structural member received in said notch, resilient biasing means acting on one of said vertical surfaces and on one of said flanks to induce the other flank to engage the opposite vertical surface.

By providing biasing means acting between the intersecting structural members, two of the juxtaposed surfaces are maintained in abutment during expansion and contraction of the structural members.

It is preferred that the biasing means acts to force the flank into engagement with the surface of the notch that extends between the interior and exterior of the building.

An embodiment of the invention will now be described by way of example only with reference to the accompanying drawings in which FIG. 1 is a perspective view of a portion of a building;

Figure 1:
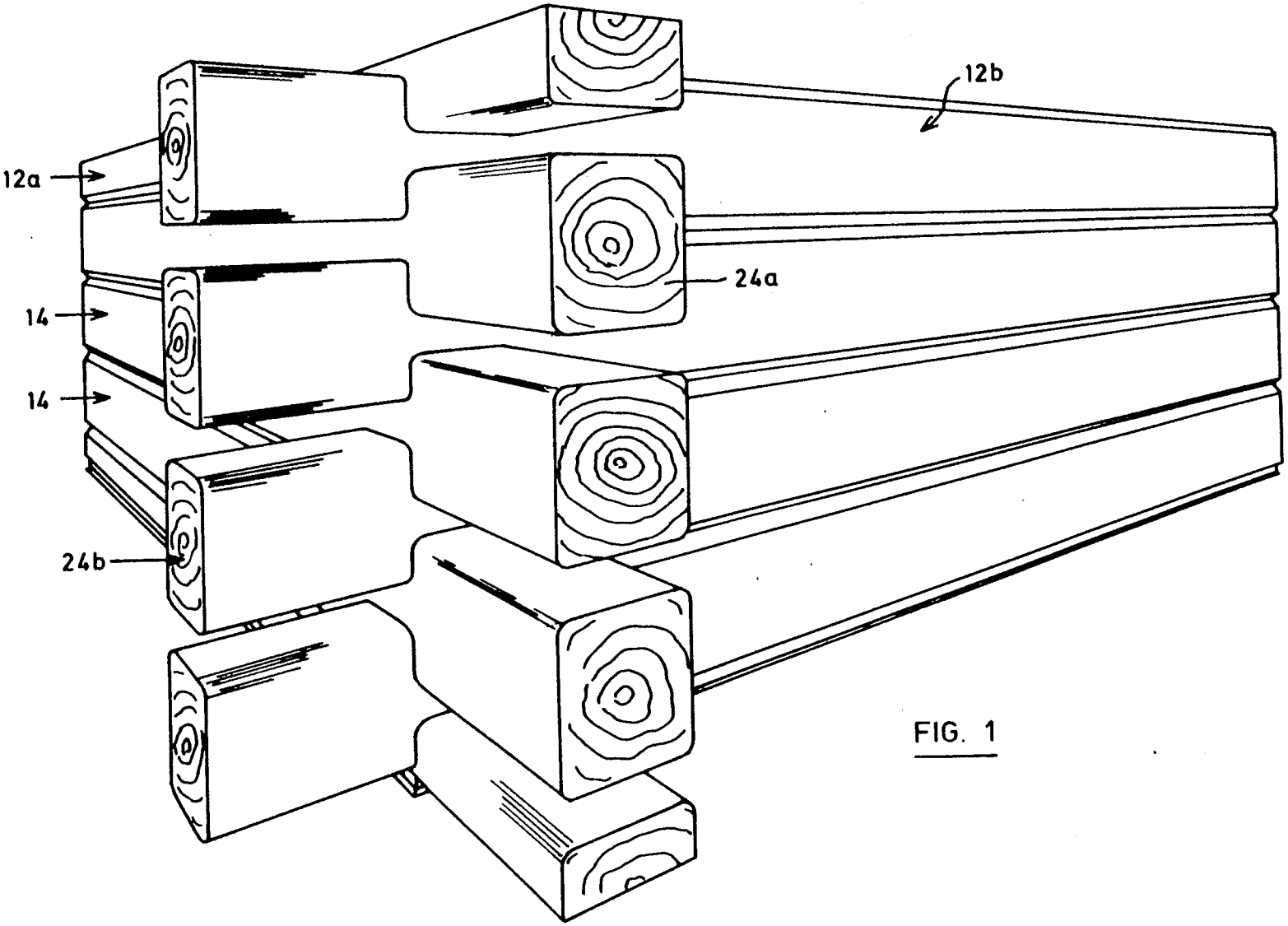

Referring therefore to FIG. 1, a building indicated generally at 10 includes a pair of intersecting walls 12*a*,12*b* each of which is formed from a number of logs 14 stacked one above the other. In the embodiment illustrated, the logs 14 have machined flanks 16,18 and machined upper and lower surfaces 20,22 respectively although it will be appreciated that unmachined logs 14 could be utilized.

As shown in FIG. 1, the walls 12*a*,12*b* intersect at a corner 21 and extend beyond one another in tail portions 24*a*,24*b* to provide structural integrity for the building 10.

Figure 3:
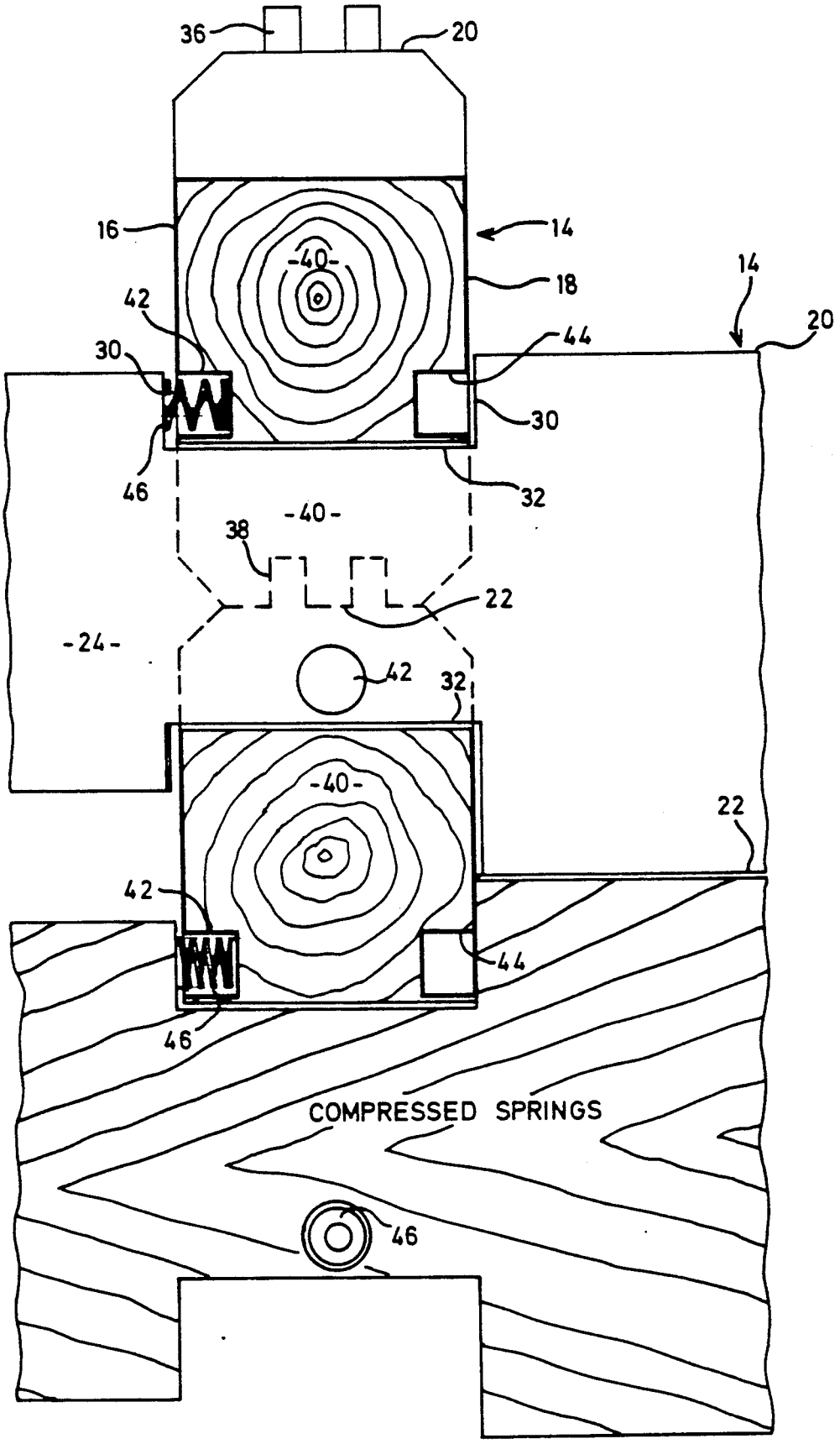
FIG. 3 is a view on the line 3—3 of FIG. 2.
Figure 4:
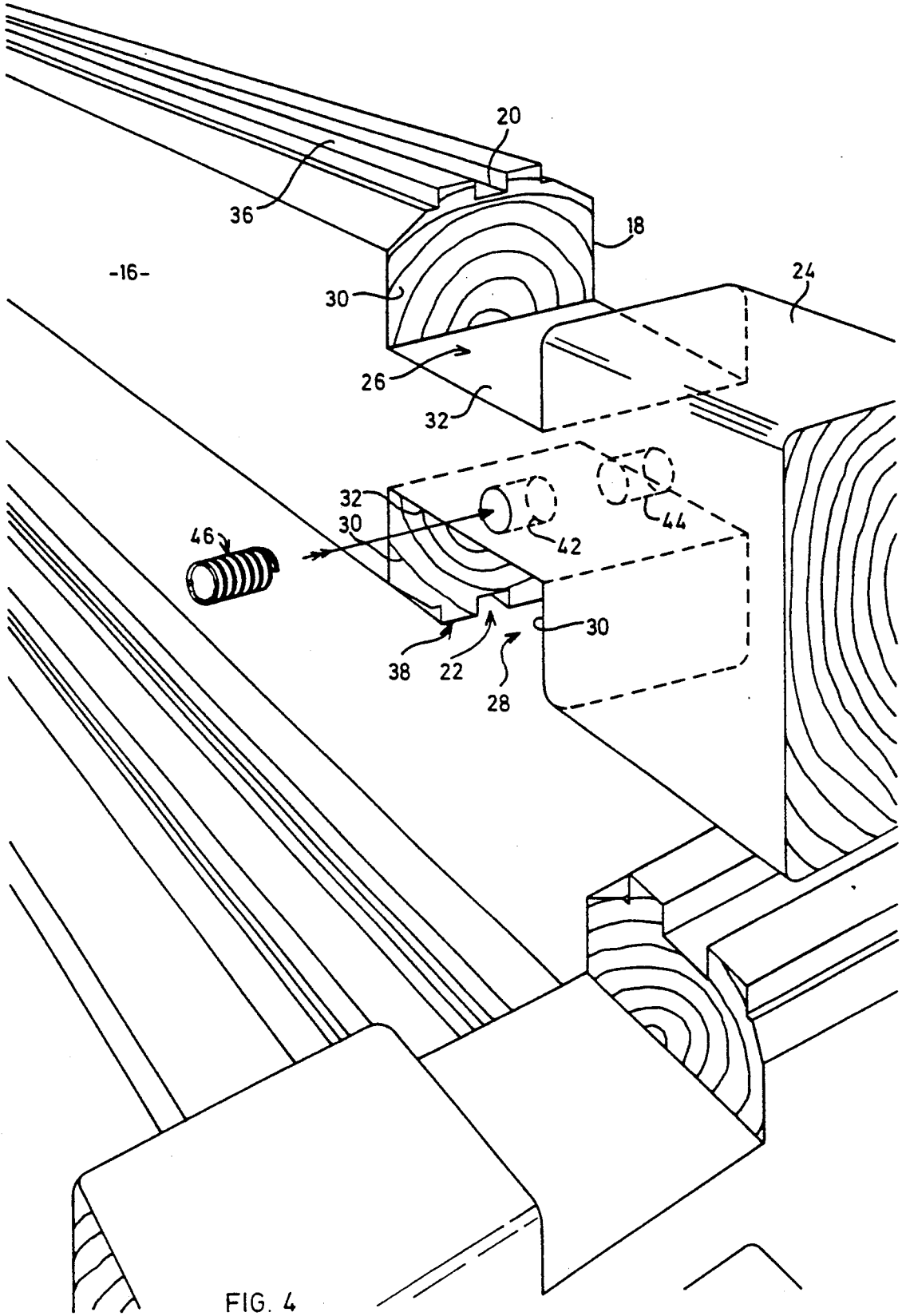
FIG. 4 is a exploded detail view of a portion of a building similar to FIG. 1.

As best seen in FIGS. 3 and 4, each of the logs 14 is notched at its upper and lower surfaces as indicated at 26,28. Each notch 26,28 is formed by a pair of opposed planar vertical surfaces 30 and a horizontal surface 32. The depth of each of the notches 30 is selected to be approximately one-quarter of the height of the log 14 so that a land 40 is formed between the horizontal faces 32 with a thickness equal to one-half of the depth of the log 14.

It will be noted that the upper and lower surfaces 20,22 respectively are machined with complementary interengaging formations 36,38 which co-operate with neoprene sealing strips (not shown) to ensure an effective seal between adjacent logs 14.

The land 40 between the horizontal surfaces 32 has a pair of blind bores 42,44 drilled into each of the flanks 16. The centre of the bores 42,44 is in the lower half of the land 40 so that the bore 42 is juxtaposed with the vertical face 30 adjacent the notch of an intersecting log.

Located within one of the bores 42 is a compression spring 46 that is slightly longer than the depth of the bore 42. Typically, such springs might conveniently be valve springs utilized on gas engine valve trains although other suitable forms of compression spring may be utilized.

To assemble the walls 12*a*,12*b*, logs 14 are alternatively stacked on each wall. The land 40 is received between the vertical faces 30 of the upwardly directed notch 26 of the lower log 14 and projects upwardly above the upper surface 20 of the lower log. The next log 14 of the wall 12 is then positioned so that the walls 30 of the downwardly directed notch 28 pass to either side of the flanks 18 of the land 40. As the upper log is lowered into place, the spring 46 is inserted into the bore 42 and compressed by means of a suitable lever to allow the end of the spring 46 to pass the flank 18 above the upwardly directed notch 26. Once in place, the lever is removed so that the spring 46 bears against the flank 18 and the end wall of the bore 42 to bias the log 14 in one direction.

Figure 2:
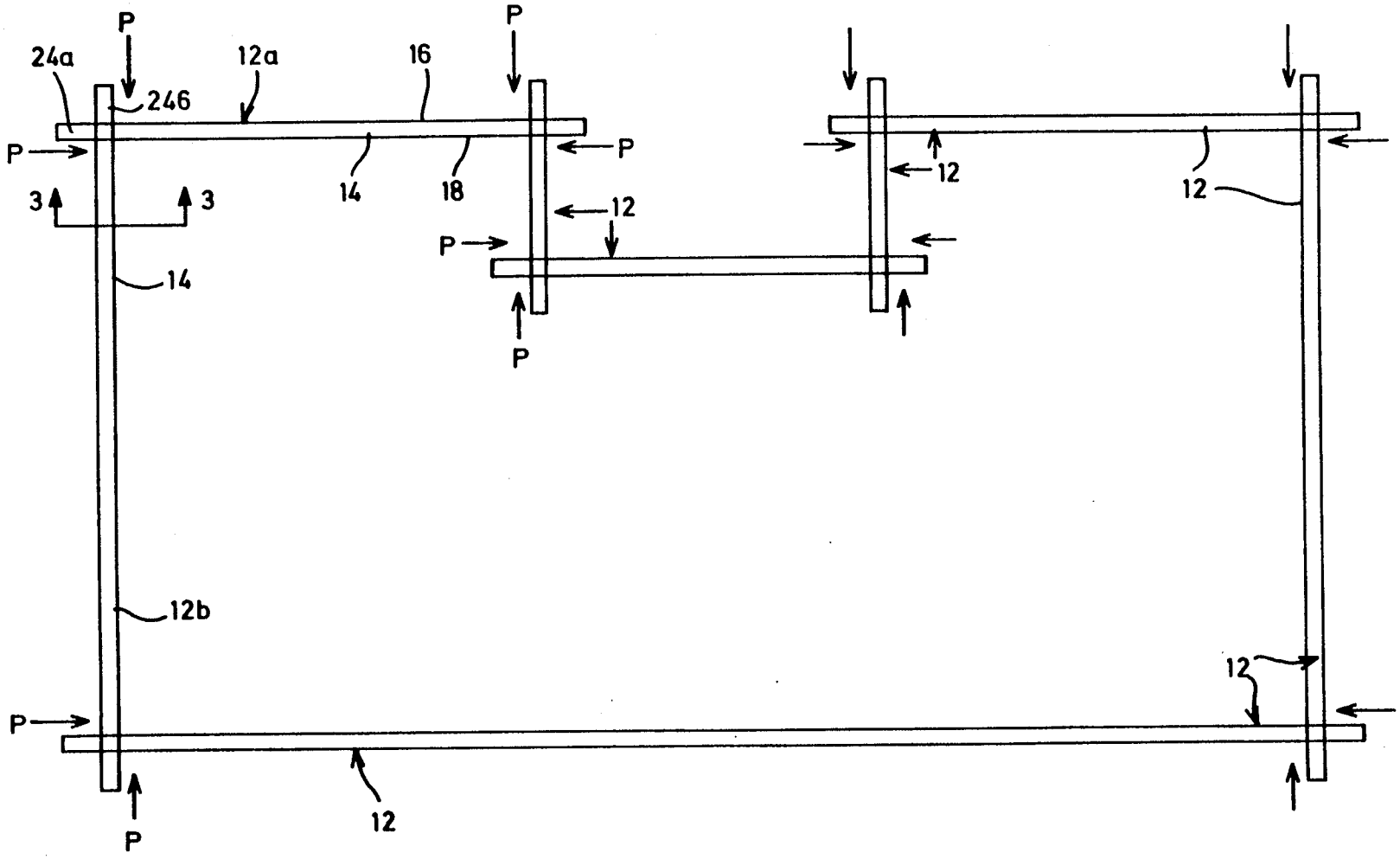
FIG. 2 is a plan view of a building.

As may be seen in FIG. 2, one of the walls 30 of each of the notches 26,28 at a corner extends between the interior and exterior of the building. As indicated by the arrows P in FIG. 2, the spring 46 is positioned in the bore 42 to bias the flank 16 of the land 40 into engagement with the wall 30 that extends from the interior to exterior of the building. In this manner, any gap that does exist in the notch is provided between the wall 30 that extends between opposite flank 16 of the tail portions 24 on the exterior of the building.

The constant force applied by the springs 46 biases the flank 16 and wall 30 into engagement so that changes in dimension of the logs 14 are accomodated by movement between the opposite wall and its juxtaposed flank. In this way, a snug fit is provided along one side of each of the notches that enables an effective and durable seal to be made.

It will be apparent that alternative forms of biasing could be used. For example an elastomeric or rubber plug could be inserted into the bore 42 to provide the biasing means or bowed leaf springs inserted between the flank 16 and vertical wall 30 on one side. It is, however, believed that the compression springs are readily available and suitable for the application envisaged.

By accomodating the expansion and contraction while maintaining a snug fit against one wall of the notch 28, the spacing between walls 30 can be dimensioned to be somewhat greater than what would otherwise be the case to facilitate assembly. Typically, a clearance of three-sixteenths of an inch may be provided so that damage to the tail portions during assembly is avoided.

I claim:

1. A corner construction for the intersecting walls of a building having walls formed from a plurality of horizontal structural members stacked one above another, each of said members having notches in at least one of their upper and lower surfaces at the corner to allow the members of each wall to extend past the other, each of said notches having a pair of spaced vertical surfaces juxtaposed with oppositely directed flanks of the structural member received in said notch, resilient biasing means acting between members of intersecting walls, said biasing means being located between one of said vertical surfaces and one of said flanks to apply and maintain a net force between members of intersecting walls acting in a direction to induce the other flank to engage the opposite vertical surface and bias the one wall toward the other.

2. A corner construction according to claim 1 wherein said biasing means are coil springs.

3. A corner construction according to claim 2 wherein each of said coil springs is located in a bore formed in said one flank.

4. A corner construction according to claim 1 wherein said opposite vertical surface extends from the interior to the exterior of said building.

5. A corner construction according to claim 4 wherein said biasing means are coil springs.

6. A corner construction according to claim 5 wherein each of said coil springs is located in a bore formed in said one flank.

7. A corner construction according to claim 1 wherein said notches are rectangular in cross section.

8. A corner construction according to claim 7 wherein each of said structural members is substantially rectangular in cross section.

9. A corner construction according to claim 8 wherein complementary formations are provided on the upper and lower surfaces of adjacent structural members between the corners to facilitate sealing therebetween.

* * * * *